United States Patent [19]

Bierman

[11] 4,453,619

[45] Jun. 12, 1984

[54] TELESCOPING WALL SCAFFOLD

[76] Inventor: John H. Bierman, 2347 Pleasant Valley Rd., Placerville, Calif. 95667

[21] Appl. No.: 202,299

[22] Filed: Oct. 30, 1980

Related U.S. Application Data

[63] Continuation-in-part of Ser. No. 98,126, Nov. 28, 1979.

[51] Int. Cl.[3] ..... E04G 3/10

[52] U.S. Cl. ..... 182/142; 182/150

[58] Field of Search ..... 182/150, 145, 82, 132, 182/222, 142, 206

[56] References Cited

U.S. PATENT DOCUMENTS

| | | | |
|---|---|---|---|
| 902,949 | 11/1908 | Dibler | 182/147 |
| 1,432,040 | 10/1922 | Schuler | 182/145 |
| 1,558,425 | 10/1925 | Yetter | 182/150 |
| 2,072,354 | 3/1937 | Biebel | 182/132 |
| 2,634,173 | 4/1953 | Mayhew | 182/147 |
| 2,964,767 | 12/1960 | Egbert | 182/150 |
| 3,158,223 | 11/1964 | Brown | 182/150 |
| 3,767,010 | 10/1973 | Newlan | 182/150 |
| 4,078,633 | 3/1978 | Fahy | 182/82 |
| 4,164,268 | 8/1979 | Jones et al. | 182/222 |

FOREIGN PATENT DOCUMENTS

| | | | |
|---|---|---|---|
| 122690 | 11/1946 | Australia | 248/355 |
| 889364 | 9/1953 | Fed. Rep. of Germany | 182/82 |
| 491412 | 1/1952 | Italy | 248/355 |

*Primary Examiner*—Reinaldo P. Machado
*Attorney, Agent, or Firm*—Trask & Britt

[57] ABSTRACT

A telescoping wall scaffold has a suspension member with a first end and a second end and shaped therebetween to extend about the overhang of a structure having a vertical surface. A leg and foot arrangement is attached to the first end for contact with the structure. A base member is attached to the second end to extend downwardly therefrom along the surface of the structure. At least one telescoping member is mechanically and telescopically adapted to the base member for telescopic movement and relation thereto. A platform support is attached to the telescoping member to support one or more platforms. A spacer member is also adapted to the telescoping member to extend away therefrom toward the surface of the structure. A wheel or roller is adapted to the spacer member for rolling contact with the surface. A winch with a reel having a rope wound thereon is also secured to the telescoping member. One end of the rope is secured to the scaffold proximate the suspension means so that upon operation of the winch means the telescoping member selectively raises and lowers along the surface.

12 Claims, 4 Drawing Figures

TELESCOPING WALL SCAFFOLD

RELATED APPLICATIONS

This application is a continuation-in-part of application Ser. No. 098,126, filed Nov. 28, 1979. Said application is the subject of a preliminary Office Action rejection dated June 30, 1980.

BACKGROUND OF THE INVENTION

1. Field: This invention relates to wall scaffolding and staging, and more particularly relates to a telescoping wall scaffold.

2. State of the Art: Various scaffold and staging devices to provide a work platform or means of working along the side of an elevated structure (such as a building or wall) have long been known. Various scaffolds have been devised in order to improve or facilitate the maneuverability of the scaffold to minimize the amount of work necessary to raise and lower a worker along the side of a surface like a wall.

U.S. Pat. No. 3,767,010 (Lewlan et al) discloses a scaffold for use on a building having an overhang. The device disclosed by Lewlan et al does not appear to provide for vertical adjustability while in use. Further, as disclosed, the device of Lewlan et al does not provide for a rotational moment about its point of suspension to hold the scaffold in place against the work surface (wall).

The device to Yetter (U.S. Pat. No. 1,558,425) similarly does not provide for adjustability in use or stability in use. U.S. Pat. No. 382,252 (Bowyer and Casperson) discloses a staging device which may or may not have a rotational moment about its point of suspension to provide some stability against the surface of the wall. The Boyer and Casperson device is notably operated by a block and tackle so that it does not have a rigid suspension structure.

U.S. Pat. No. 2,634,173 (Mayhew) discloses a device which here also does not have sufficient rotational moment to maintain the scaffold against the sidewall of the structure. Furthermore, the device of Mayhew is not in and of itself adjustable in height. Other staging and scaffold devices that may be of interest are disclosed in U.S. Pat. Nos. 4,078,633 (Fahy); 2,072,355 (Biebel); and 902,949 (Dibler).

It may be noted that none of the scaffold or staging devices above mentioned specifically provide for a stable, rigid and adjustable in height staging device which may be used against the side of a structure of varying height, while at the same time having a rotational moment to hold the platform stably against the side of the structure.

SUMMARY OF THE INVENTION

A telescoping scaffold has suspension means for suspending the scaffold from a first point on the structure having an upwardly extending surface. A base member is removably attached to the suspension means to extend downwardly along the surface and spaced therefrom. A telescoping member means is mechanically and telescopically adapted to the base member for telescopic movement in relation thereto. A platform member is secured to the telescoping member means to support a platform. The spacer member is adapted to the telescoping member to adjustably extend away therefrom toward the surface. A wheel device is rotatably adapted to the spacer member for rolling contact with the surface. Winch means is secured to the telescoping member. The winch has a reel with a rope which extends upwardly along the length of the scaffold, the end of which is secured thereto approximate the suspension means. Upon operation of the winch means, the telescoping member is selectively raised and lowered along the surface.

In another embodiment, the telescopic member may be one or a plurality of telescoping members wherein one telescopes over or into the other. A plurality of safety brake devices may be provided and mechanically associated with the base member, a telescoping member and between each subsequent telescoping member and the one thereafter, which is operative between a brake position to inhibit downward movement of the first telescoping member with respect to the base in each other telescoping member with respect to its predecessor telescoping member.

In a preferred embodiment, the suspension means has a first end and a second end and is shaped therebetween to extend about an overhang intersecting and extending outwardly from the surface. The suspension means may also include a second spacer member adjustably secured thereto and to extend away therefrom for contact with the surface. The suspension means may also include a leg member adjustably secured to the first end and adjustable along the length of the leg member. A foot may be secured to one end of the leg member to be movable thereabout for contact with the structure. The foot preferably has a bottom surface with friction means associated therewith. The wheel means is preferably elongated, soft surface rollers with a radius selected to be at least as large as any irregularities on the surface.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
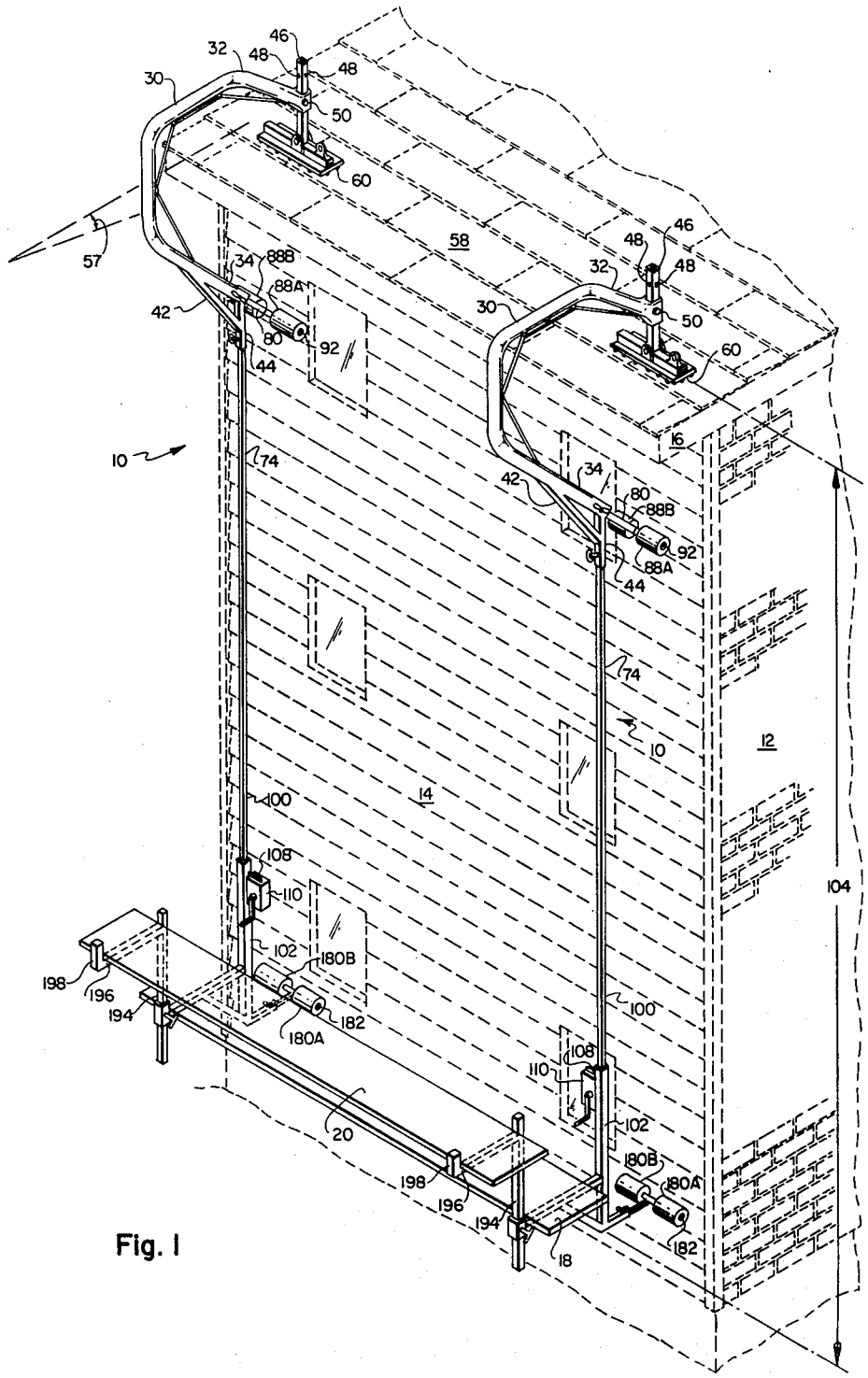
FIG. 1 is a perspective view of a pair of wall scaffolds of the instant invention in use along the wall surface of a structure.

FIG. 1 shows a pair of wall scaffolds generally indicated by the numeral 10 mounted on a building structure 12 having a wall surface 14 which is upwardly extending. The structure 12 also has an overhang 16 extending outwardly from the surface 14. FIG. 1 depicts a pair of wall scaffolds 10 in use to support a personnel platform 18 and a work deck 20.

Figures 2, 2A:
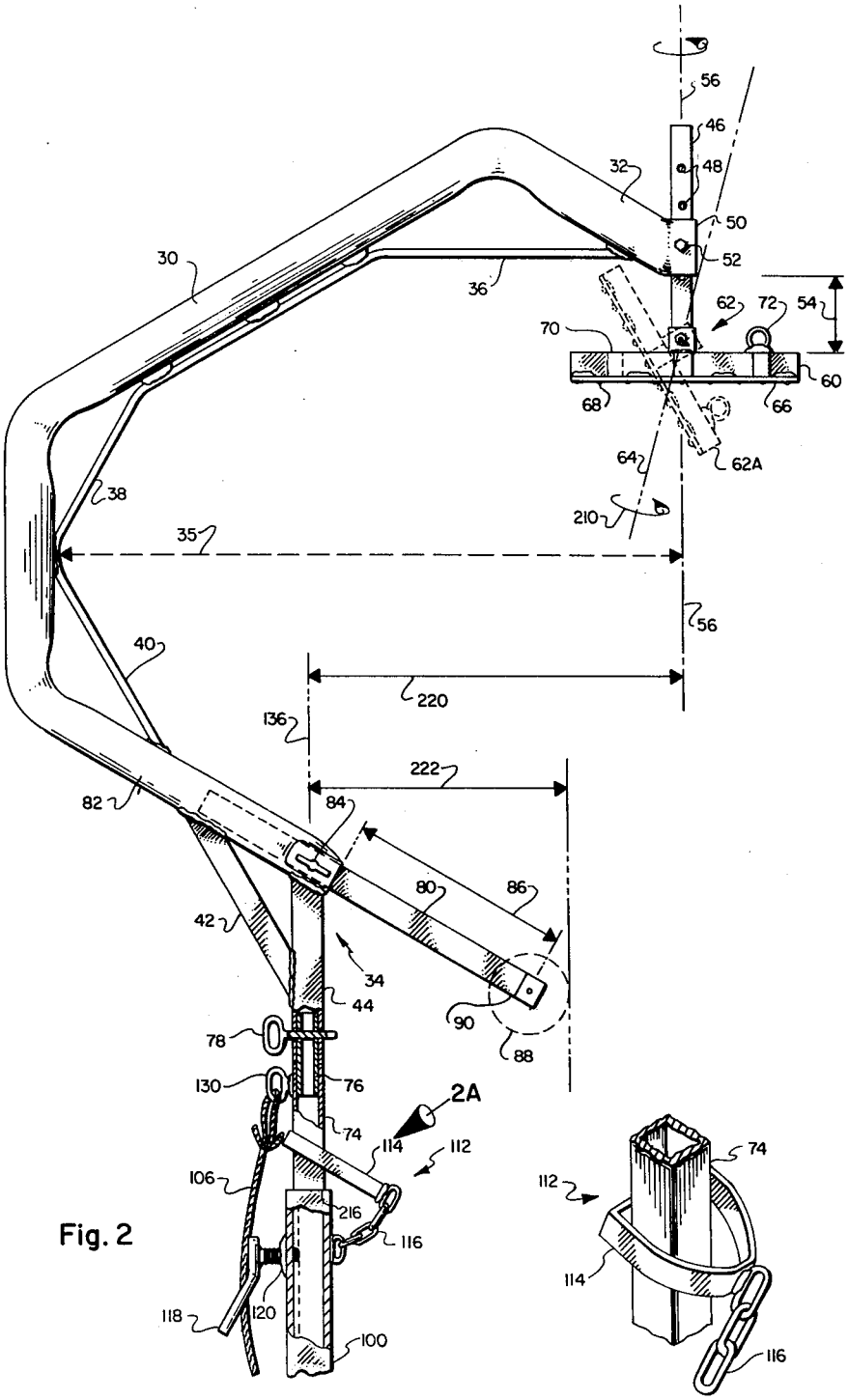
FIG. 2 is a partial cut-away view of the upper portion of a wall scaffold of the instant invention.
FIG. 2A is a partial perspective view of a safety brake for use with the scaffold of the instant invention.

FIG. 2 shows the upper portion of the wall scaffold 10 of the instant invention in greater detail. In particular, the upper portion of the wall scaffold has suspension means 30, which is here illustrated to be a C-shaped member having a first end 32 and a second end 34. The particular suspension means depicted is shaped between the first end 32 and second end 34 so that it can readily pass around or about any typical overhang, such as the overhang 16 illustrated in FIG. 1. Those skilled in the art will recognize that the depth of the throat 35 may be selected to accommodate virtually any overhang. The suspension means 30 here illustrated is made out of a tubular metal material with reinforced strut members 36, 38 and 40, as illustrated. In addition, an angle member 42 is provided to reinforce a downwardly extending connecting member 44, as more fully discussed hereinafter.

The first end 32 has a leg 46 adjustably adapted thereto. As can be seen from FIGS. 1 and 2, the leg has a plurality of apertures 48 formed therein. The leg 46 is sized to fit within a sleeve 50 and is held in position within the sleeve by a bolt 52 or other suitable fastening means. In operation, the length 54 of the leg 46 extending below the first end 32 can be adjusted along the axis 56 to accommodate the pitch 57 of different surfaces (e.g., roofs) or other variables associated with the scaffold support surface 58 of the structure 12.

A foot 60 is rotatably adapted to the lower end 62 of the leg 46. The rotatability is illustrated by showing the foot 60 in an alternate position 62A in FIG. 2. The foot 60 rotates about an axis 64 to accommodate differently pitched surfaces 58 so that a flat or smooth contact can be obtained between the bottom 66 of the foot 60 and the support surface 58. It may be noted that the leg 46 is rotatable within the sleeve 50 so that the foot 60 can be oriented, in effect, normal to the suspension member 30, as shown in FIG. 1, or in basic axial alignment with the suspension member 30 as shown in FIG. 2. The foot 60 has a plurality of bumps 68 affixed to the bottom surface 66. These bumps 68 constitute friction means and are preferably formed by simply placing a plurality of spot welds in accordance with a preselected pattern on the bottom surface 66 of the foot 60, which is preferably formed out of metal. The spot welds are not polished or burnished in any way. Rather sharp or abrupt surfaces as they are formed are desired in order to improve the frictional characteristics of the bumps 68 when in use with a soft surface, such as wood, frequently found as the supporting surface 58.

A plurality of apertures 70 may be formed in the foot 60 (as shown in FIG. 2) so that in selected circumstances a user may secure the foot 60 to the surface 58 with nails, screws or similar devices. Also, a ring 72 may be attached to the foot 60 so that in some circumstances a rope or line may be tied thereto and then run to a supporting structure, such as a chimney, nearby tree, building members or the like to provide additional support based on the nature of the surface 58 and the desires of the user.

It can be seen that in operation the adjustability of the leg 46 and foot 60 allows for three dimensional flexibility to accommodate virtually any surface 58. One skilled in the art may also recognize that a ball joint type arrangement may be used to adapt the foot 60 in to the end of the leg 62 to similarly accommodate surfaces 58 of different pitches and characteristics.

As hereinbefore noted, an extension 44 extends downward from the suspension member 30 at the second end 34. The extension 44 is here shown to be welded to the C-shaped member 30. The angle member 42 provides rigidity to the extension 44. A base member 74 is removably secured to the extension 44. As here shown, the base member 74 has a sleeve 76 sized to fit within the extension 44 so that the external surfaces are smooth and so that an abutting mechanical relationship can be obtained between the extension 44 and the base member 74. The base member 74, and in particular the sleeve 76, is secured to the extension 44 by a removable pin 78 which is inserted through appropriately indexed apertures formed in both the extension 44 and the sleeve 76 of the base member 74.

The suspension means 30 also has a spacer member 80 adapted thereto to extend away therefrom towards the surface 14, as shown in FIG. 1. As best seen in FIG. 2, the spacer 80 is adjustably adapted to the suspension member 30 to slide into a hollow portion internal the lower leg 82 of the suspension member 30. A wing bolt 84 with a nut and aperture in the lower leg are provided to frictionally secure the spacer 80 at a desired length 86 for supportive contact with the surface 14 of the structure 12. It may be desired to place or secure a cushioning device 88 on the end 90 of the spacer 80. The preferred cushioning device 88 is a round, soft, roller device adapted to cross members 92 extending substantially normal to the spacer 80. The cushioning device 88 is preferably a soft roller device which may be a readily available paint roller. Polyfoam rollers are particularly well suited. The supporting members 92 may be sized to frictionally hold or rotatably hold, if desired, the device 88 in place. Paint rollers have been empirically found to be ideal since the weight or force exerted against the wall structure is sufficiently distributed to avoid denting, marring or scratching of the surface 14. This is specifically of interest with respect to aluminum siding and other particular siding materials which may be placed on the sides of homes or similar building structures.

Figure 3:
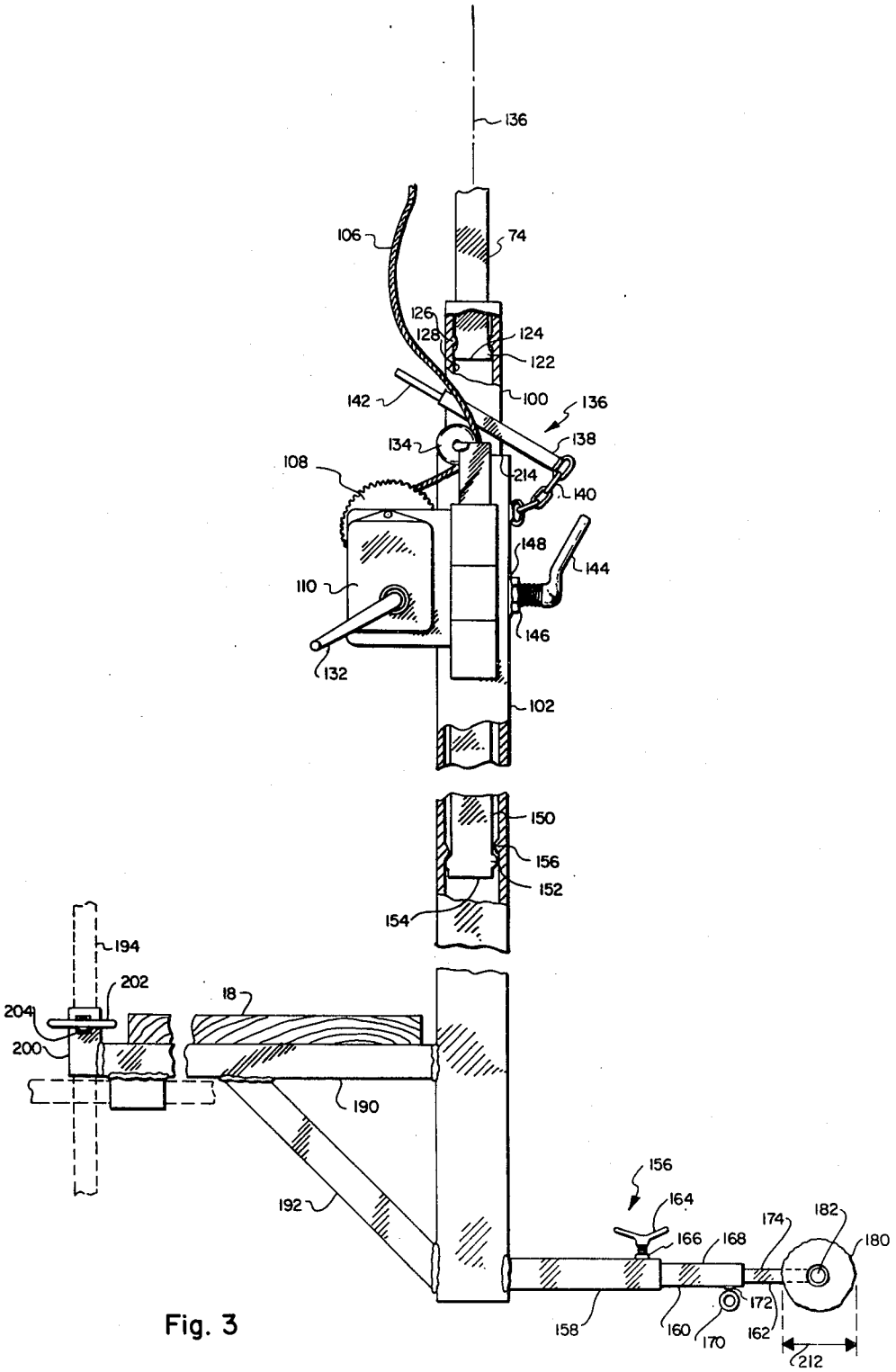
FIG. 3 is a partial cut-away side view of a wall scaffold of the instant invention.
Figure 4:
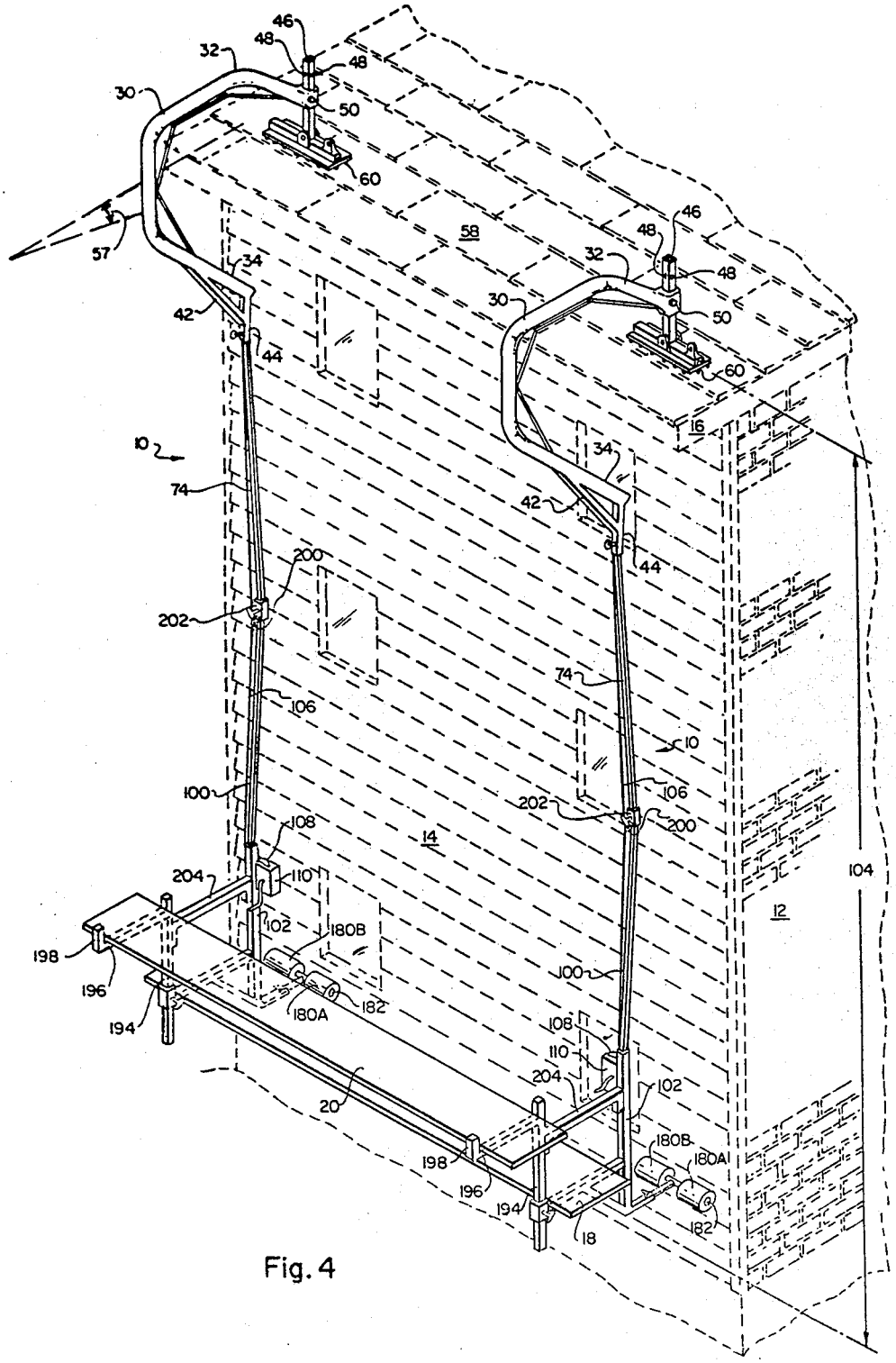
FIG. 4 is a perspective view of another embodiment of a pair of wall scaffolds.

Telescoping member means is telescopically and mechanically adapted or associated with the base member 74. The telescoping means is illustrated in FIGS. 1, 2 and 3 and is comprised of a first telescoping member 100 and a second telescoping member 102. A plurality of interacting telescoping members can be provided, as desired, to provide a preselected height in a maximum extended condition. It may also be recognized that only one telescoping member may be used as a telescoping means for scaffolds in which a shorter height is desired.

The first telescoping member 100, as shown in more detail in FIG. 2, telescopically fits over the base 74. Those skilled in the art will recognize that telescoping could also be effected by having the telescoping member 100 fit within the base 74 which would be suitably hollow. The telescoping member means and the base 74 in the particular embodiment here illustrated are rectilinear or square in cross-section metal tubing members having an acceptable wall thickness for the particular weight and size of the scaffold. In the embodiment here illustrated, the square metal tubing is used having an outside dimension from about one to about four inches.

The first telescoping member 100 is mechanically and telescopically adapted to the base 74 and is held, in effect, in place by a rope 106 connected to the reel 108 of winch means 110, as more fully discussed hereinafter. In the event of a failure of the rope 106, a safety mechanism 112 is provided. The safety mechanism 112 is comprised of a lever brake 114 with a chain 116 connected to the brake and to the first telescoping member 100. The arrangement of the brake 114 is better illustrated in FIG. 2A. Should the rope fail, the weight of the platform 18, deck 20 and structure below, including the weight of the first telescoping member 100, would cause the telescoping member and structure therebelow to proceed in a downwardly direction. This downwardly force would be transmitted via the chain 116 to the brake 114 to develop a frictional lock on the base 74.

This, in turn, would preclude a free fall of the scaffold with the hazard associated therewith.

In addition to the brake mechanism 112, a lock or friction lock mechanism is also provided in the illustrated embodiment. A handled bolt 118 is provided to pass through an appropriately threaded nut which is welded 120 to the outside of the first telescoping member 100. The threaded bolt 118 passes through the nut 122 and through a suitable aperture in the sidewall of the first telescoping member 100. Upon application of force through the handled bolt 118, a frictional lock can be applied against the outside surface of the base member 74 to lock the first telescoping member 100 in place. This feature is considered desirable so that preadjustment of height can be made readily and easily while the scaffold 10 is on the ground before raising it and placing it in position for use with respect to a structure 12.

To preclude mechanical disassociation of the first telescoping member 100 from the base 74, the base 74 is provided with a tongue 122 secured to its lower end 124. The tongue 122 is sized to provide for easy movement of the first telescoping member 100 with respect to the base 74. The tongue 122 contacts a corresponding tongue 126 attached to the inside surface 128 of the first telescoping member 100. Thus, upon accidental extension beyond what would be reasonably regarded as permissible in ordinary use, the tongue 122 of the base member 74 will contact the tongue 126 of the first extension member and preclude further extension thereof and mechanical disassociation therebetween. Thus, telescopic mechanical association is maintained.

As shown in FIG. 3, the second telescoping member 102 is here provided to have the winch means 110 fixedly secured thereto. The winch means 110 has a reel 108 upon which the rope 106 is wound. The rope 106 is extended along the length 104 of the scaffold 10 and its running end is connected to a ring 130 adapted proximate the suspension means 30, and as here shown is secured to the extension member 44. The rope 106 may be a metal wire rope or a conventional nylon or similar non-metallic rope material, as desired by the user. However, it should be noted that in the preferred embodiment, metal rope is used in that it is more reliable and supports greater weight and is less acceptable to damage from the mechanical equipment which may be used on a scaffold, and which in turn could damage the rope.

As can be seen, the winch 110 has a crank or handle 132 through which raising and lowering forces to wind and unwind the rope 106 can be delivered to the reel 108. The particular winch here employed is a DATON AND LOSON Model B1200 Cable Winch. This particular model is preferable because it operates in such a fashion that it must be manually operated to raise as well as lower. It is not a "let fly" type winch for lowering. That is, it does not have a free fall characteristic to it. This feature is highly desirable to minimize danger or hazard to those operating the winch 110. The rope 106 passes through a pulley 134 in order to align the rope with the axis 136 of the telescoping means and the base member 74. The alignment is desired to minimize interference with work in progress about the telescoping means and base member 74. The rope 106, however, is shown to deviate from axial alignment in order to facilitate illustration.

It should be noted that the second telescoping member 102 also has a safety mechanism 136 associated with its telescopic interconnection with the first telescoping member 100. This mechanism 136 is similar in function and in operation with the mechanism illustrated in FIG. 2A. This mechanism 136 has a brake member 138 and a chain 140 fixedly secured to one end of the brake 138 and to the second telescoping member 102. The brake 136 also has a handle 142 associated therewith for operation by the user when lowering the platform. The second telescoping member 102 has also a handle locking bolt 144 which is threaded into a nut 146 secured to the outside of the telescoping member 102. The nut 146 is here shown to be welded 148 to the outside surface of the second telescoping member 102. A suitable aperture is formed in the wall of the second telescoping member 102 so that upon operation of the handle bolt 144 a pressure can be brought to bear against the outside surface 150 of the first telescoping member 100.

To preclude mechanical disassociation between the first telescoping member 100 and the second telescoping member 102, an appropriate tongue 152 is formed at the bottom 154 of the first telescoping member 100 to coact with a second tongue 156 formed on the inside wall surface of the second telescoping member 102. This precludes mechanical disassociation therebetween.

A second spacer member 156 is adapted to the second telescoping member 102. The second spacer member 156 is adjustably secured and is here comprised of a first extension 158, a second extension 160 and a third extension 162. The first extension 158 is secured to the outside surface of the second telescoping member 102 and extends away therefrom substantially normal to the axis 136 towards the wall surface 14. The first extension 158 is a hollow metal tube. A locking device, here shown to be a winged or handle bolt 164, and a nut 166 which is secured to the outside of the first extension 158 with an appropriate aperture associated therewith so that in operation the winged bolt 164 can be manually turned to exert a force against the outside surface 168 of the second extension 160 to in turn lock it in place at the desired distance. The second extension 160 is similar to the first extension and also has a locking arrangement, here shown to be again a handled bolt 170 which operates through a nut 172 affixed to the outside surface 168 of the second extension. Thus, locking pressure can be exerted against the outside surface 174 of the third extension. Those skilled in the art will recognize that various devices may be employed to provide an adjustable extension member. For example, a sleeve could be adapted to the outside surface of the second extension member having a wing nut locking arrangement similar to those disclosed herein.

A soft-paint-roller type device 180, is affixed to the end of the third extension 162 to constitute wheel means. The wheel means are an elongated roller rotatably adapted over extension members 182, which extend away from the end of the third extension member 162. A pair of soft rollers 180A and 180B is preferably employed to provide better stability to the platform 18 and to the scaffold 10.

Platform support means, here shown to be comprised of a platform base member 190 and a platform angle support 192, are affixed to the second telescoping member 102. The platform support means receives a platform 18 of sufficient strength to support one or more personnel for working operations. The platform 18 may be bolted or otherwise secured to the platform support means, or may not be depending upon the use or the environment of the scaffold. The platform support means may also include a working platform or working deck 20, as best shown in FIG. 1. The working deck 20 has supporting structure comprised of an elevational member 190 and a deck support member 196 which extend normal substantially to the member 194. As best shown in FIG. 1, the deck support 196 extends away from the member 194 just below the top thereof. A retaining member 198 is adapted to the deck member 196 at its distal end. Thus, a C-shaped receptacle is provided to receive the work deck or working platform 20. The height of the work deck is adjustable, as can be seen through a hollow sleeve 200 and a handled locking nut 202 adapted to the sleeve through a nut 204 and an appropriately sized aperture so that a locking force can be asserted against the outside surface of the member 194.

It can be seen that the working deck 20, together with its supporting structure, provides in function a guardrail adjustable in height and useful for safety purposes as well as a place to martial materials and to perform various working functions.

To use the scaffold 10 of the instant invention, it is transported to a work site either assembled or disassembled. If it is disassembled, it must obviously be put together before use. Assembly typically involves joining the base member 74 to the extension 44 with the bolt 78. A preselected initial height is selected and fixed with the locking bolts 144 and 118, if desired. The leg 46 and foot 60 are also adjusted for use to establish the optimum suspension point for the scaffold. After assembly, the scaffold is raised and placed on the structure 12. It is important to note that the scaffold, as herein disclosed, can be typically assembled and maneuvered into place by one man. It is compact and light weight in relation to other devices. It is also important to note that it can be raised and hung from its suspension point from the ground level or any other convenient work staging area. After one scaffold 10 is positioned, its companion, as shown in FIG. 1, is similarly assembled and positioned.

After the scaffold 10 is positioned on the structure 12 and the working personnel platform 18 and the working deck 20 are in position, the operator may mount by any means, including a ladder if necessary. After the user operator has mounted the personnel platform 18, he may loosen a lock bolt 118 or 144 and then operate the crank 132 of each of the winches 110 and raise one end of the personnel platform 18 and then the other 102 until the personnel platform 18 is positioned as desired and in an appropriate location along the side or along the surface 14 of the structure 12. In the raising and lowering process, the wheel means, which are the rollers 180A and 180B, roll along the surface 14. The wheel means has a diameter 212 which is selected so that it can readily roll over any normal obstructions which would be found on a wall structure. Typical obstructions are the overlap of siding or sidewall materials typically found on building structures.

As the second telescoping member 102 is raised, it should be noted that the upper edge 214 of the second telescoping member comes in contact with the brake arm 138 to cause it to release so that upward movement can be readily effected and the brake is automatically released. In downward movement, the user must affirmatively use the handle 142 to release the brake so that downward movement can be readily effected. As work proceeds up the side of the building in a typical fashion, work may come close to or be in the vicinity of the spacer member 80. As work proceeds that high, adequate support will be obtained from the second spacer means 156 so that in turn the spacer 80 may be loosened and housed internal the suspension means 30. This will facilitate work in the area of the first spacer member 80. It should be noted that in the raising process, the upper edge 216 of the first telescoping member 100 similarly contacts the brake member 114 so that upward movement can be automatically effected. Lowering thereof is similarly effected. Lowering is preferably done so that the first member to be lowered is the first telescoping member 100 and then the second telescoping member 102 so that the user may readily grasp or hold the brake 114 between the base member 74 and the first telescoping member 100. Those skilled in the art will recognize, however, that a variety of different means may be employed to release the brake 114 when lowering is desired should the user be unable to reach the same physically. Such means may very well be a handle comparable to the handle 142 with a string arrangement so that releasing can be readily and easily effected from below the telescoping members.

In operation, it has been found that a scaffold 10 as illustrated in FIG. 1, is substantially more efficient in use than any other scaffold device heretofore known. Specifically, the personnel platform is positioned such that adequate weight generates a holding moment so that the structure scaffold itself is quite stable. The spacers 80 and 156 further contribute to the stability and in turn the psychological feeling of security to those working on the platform. It precludes wobble and movement as various forces are exerted in the course of work. That is, the rotating moment against the building must be exceeded before the personnel platform 18 and the work platform 20 start to move away from the work surface 14. With one or two people working on the personnel platform 18, it can be seen that such a force would need to be quite substantial to overcome the total moment because of the length of the moment arm 220. At the same time, the distance from the work surface 222 is sufficient so that work can be easily performed in a safe fashion. The distance 222, of course, can be adjusted by the user to that found comfortable. Frequently, many scaffolds are too close to the structure such that much of the usable scaffold surface cannot be used readily because some distance is needed in order to provide visual separation from the work, as well as an arms length separation to facilitate work.

It should also be noted that one scaffold device can be used in combination with another scaffold device, as illustrated in FIG. 1. Alternately, a conventional ladder and bracketing arrangement, as known to those skilled in the art, can also be used as one of the two scaffold devices. However, in such a fashion, the ladder technique severely reduces the flexibility of the instant invention, but still provides many of the benefits as herein described.

The invention is herein described for use with respect to a surface 14 which is shown to be the vertical wall surface of a house under construction. The invention may be used along virtually any surface in which a suspension method or point can be had. It may be used on sharply pitched roofs with the suspension point on the other side of the roof peak. It may be used internal to a structure as well as external.

FIG. 3 illustrates another embodiment of applicant's invention. In this embodiment, the spacer member 80 and rollers 88A, 88B are eliminated. The C-shaped member 30 is of sufficient dimension and angle to maintain the distance from the work surface 222 for the operator to work on the vertical structure. Also, the angle maintains sufficient moment.

To prevent the base 74 from bowing too much over longer extensions, a sleeve cable guide 200 is slideably mounted along the base 74. This cable guide 200 is secured to the base 74 at a preselected point through securing means 202, e.g., a handled locking nut. The cable guide 200 is structured to enable the cable to pass through it, and is positioned at a point along the base 74 to form the cable 106 into a truss. Thus secured, the cable guide 200 and cable 106 act as a truss to add strength and rigidity to the base 74. Depending upon the desired length of the base 74, the cable guide 200 is shifted by the operator along the base 74 to a point for maximum stabilization proximate its center length.

A railing 204 may be attached to the telescoping member 102 and member 194. This railing 204 prevents an operator from walking off the scaffold 10, while adding strength to the platform support means.

It is to be understood that the embodiments of the invention above-described are merely illustrative of the application of the principals of the invention. Reference herein to details of the illustrated embodiment is not intended to limit the scope of the claims, which themselves recite those features regarded as essential to the invention.

I claim:

1. A telescoping scaffold comprising:

suspension means for hanging said scaffold from a structure having an upwardly extending surface such that said scaffold is held approximately adjacent said surface;

a base member removably attached to said suspension means, adapted to extend downwardly along said surface therefrom when said suspension means is positioned to suspend said scaffold from said structure;

telescoping member means mechanically telescopically adapted to said base member for telescopic movement in relation thereto;

platform support means secured to said telescoping member means to support a platform;

a spacer member adapted to said telescoping member means to adjustably extend away therefrom toward said surface;

wheel means rotatably adapted to said spacer member for rolling contact with said surface;

winch means secured to said telescoping member means, said winch means having a reel with a line extending upwardly along the length of said scaffold, the running end of said line being secured to said scaffold proximate said suspension means so that upon operation of said winch means said telescoping member means selectively raises and lower along said surface; and a cable guide slideably mounted along the base member, said guide having an aperture through which the line passes to be held in proximity with the base member, and locking means to secure said guide at a preselected point along the base member.

2. The telescoping scaffold of claim 1 wherein said telescoping member means is at least one hollow telescoping member sized to snugly and slideably telescope along the length of said base member.

3. The telescoping scaffold of claim 1 wherein said telescoping member means is comprised of a plurality of telescoping members telescopically and mechanically adapted to each other, the first telescoping member being sized to snugly and slideably telescope along the length of said base member, and each other telescoping member being sized to snugly and slideably telescope along the length of the preceding telescoping member.

4. The telescoping scaffold of claim 3 further including a plurality of safety brake means, one of which is mechanically associated with said base member and said first telescoping member and with others mechanically associated with a telescoping member and its predecessor telescoping member, wherein each brake means is operative between a brake position to inhibit downward movement of said first telescoping member with respect to said base and each other telescoping member with respect to its predecessor telescoping member.

5. The telescoping scaffold of claim 1 wherein said suspension means has a first end and a second end and is shaped therebetween to extend about an overhang intersecting and extending outwardly from said surface.

6. The telescoping scaffold of claim 5 wherein said suspension means includes a second spacer member adjustably secured thereto to extend away therefrom for contact with said surface.

7. The telescoping scaffold of claim 5 wherein said suspension means includes a leg member adjustably secured to said first end adjustable along the length of said leg member and foot means secured to one end of said leg to be movable thereabout for contact with said structure at said first point.

8. The telescoping scaffold of claim 7 wherein said foot means has a bottom surface with friction means secured thereto.

9. The telescoping scaffold of claim 1 wherein said wheel means is an elongated in width soft surfaced roller with a radius selected to be at least as large as any irregularities on said surface.

10. A telescoping scaffold according to claim 9, wherein the roller is made of a polyfoam material.

11. A telescoping scaffold according to claim 4, wherein the safety brake means releases in response to the upward movement of the telescoping member.

12. A telescoping wall scaffold comprising:

suspension means for hanging said scaffold from a first point on a structure having a substantially vertical wall surface below said first point and an overhang extending outwardly from said surface, said suspension means having a first end and a second end and shaped therebetween to extend around said overhang to a second point below said overhang, said suspension means including a leg member adjustably secured to said second end and a foot member secured to said leg for contact with said structure at said first point;

an elongated substantially straight base member removably attached to said suspension means to extend downward from said second point when said suspension means is so positioned with respect to said first point;

at least one telescoping member mechanically telescopically adapted to said base member for telescopic movement in relation thereto;

platform support means secured to said telescoping member means to support a platform;

a spacer member adapted to said telescoping member means to adjustably extend away therefrom toward said surface;

wheel means rotatably adapted to said spacer member for rolling contact with said surface;

winch means secured to said telescoping member means, said winch means having a reel with a line extending upwardly therefrom along the length of said scaffold, the running end of said line being secured to said scaffold proximate said suspension means so that upon operation of said winch means said telescoping member means selectively raises and lowers along said surface; and a cable guide slideably mounted along the base member, said guide having an aperture through which the line passes to be held in proximity with the base member, and locking means to secure said guide at a preselected point along the base member.

* * * * *